US005601233A

United States Patent [19]

Kageyama et al.

[11] Patent Number: 5,601,233

[45] Date of Patent: Feb. 11, 1997

[54] CONTAINER

[75] Inventors: Isao Kageyama; Michiaki Fujita, both of Tokyo, Japan

[73] Assignee: Kao Corporation, Tokyo, Japan

[21] Appl. No.: 543,263

[22] Filed: Oct. 18, 1995

[30] Foreign Application Priority Data

Oct. 28, 1994 [JP] Japan ..... 6-265402

[51] Int. Cl.[6] ..... B65D 5/54

[52] U.S. Cl. ..... 229/216; 229/125.42; 229/242

[58] Field of Search ..... 229/125.42, 216, 229/217, 219, 242

[56] References Cited

U.S. PATENT DOCUMENTS

| | | | |
|---|---|---|---|
| 3,232,514 | 2/1966 | Swede et al. | 229/216 |
| 3,339,820 | 9/1967 | Krzyzanowski | 229/216 |
| 3,347,444 | 10/1967 | Rausing et al. | 229/216 |
| 3,795,359 | 3/1974 | Rausing | 229/216 |
| 4,301,927 | 11/1981 | Carlsson et al. | 229/216 |
| 4,362,245 | 12/1982 | Kuchenbecker | 229/216 |
| 4,634,008 | 1/1987 | Strole et al. | 229/216 |
| 4,813,546 | 3/1989 | Gordon et al. | 229/125.42 |
| 4,915,236 | 4/1990 | Kamin et al. | 229/216 |
| 5,150,833 | 9/1992 | Hong | 229/125.42 |
| 5,246,162 | 9/1993 | Heuberger et al. | 229/217 |

FOREIGN PATENT DOCUMENTS

| | | | |
|---|---|---|---|
| 949939 | 6/1974 | Canada | 229/216 |
| 1134 | 3/1979 | European Pat. Off. | 229/217 |
| 49460 | 4/1982 | European Pat. Off. | 229/216 |
| 2126562 | 3/1984 | United Kingdom | 229/216 |
| 2174979 | 11/1986 | United Kingdom | 229/125.42 |

*Primary Examiner*—Gary E. Elkins

*Attorney, Agent, or Firm*—Oblon, Spivak, McClelland, Maier & Neustadt, P.C.

[57] ABSTRACT

A container comprises a hexahedron-shaped container body having a pair of side wall members and a top plate member; a pair of lug members provided on an upper end portion of the container body and extended sidewardly; and a sealing wall member, provided in an erected posture between extended end portions of the lug members. A protruded portion is formed on at least one end portion of the sealing wall member and protruded upwardly beyond an upper edge portion of the sealing wall member.

1 Claim, 5 Drawing Sheets

CONTAINER

BACKGROUND OF THE INVENTION

1. Field of the Invention

This invention relates to a container for filling liquid substances such as drinks, body soap, shampoo and rinse, in particular a container suitable for a refill container.

2. Description of the Related Art

As is known, most of commercially available liquid substances such as body soap, shampoo and rinse are filled in a container molded of resin, for example, a so-called pump container so as to increase easiness in handling. In view of waste-disposal and resource-saving problems, there have been attempts to reuse these resin molded containers as opposed to disposing them as waste after the contents within the container are used up. When reused, the vacant resin molded container is charged with the contents contained in a so-called refill container.

As the refill container, a so-called flat top type paper carton container, which has been used for containing drinking substances, has been conventionally used. The conventional flat type paper carton containers comprise a hexahedron-shaped container body having a pair of side wall members and a top plate member; a pair of lug members, each being triangle-shaped in a plan view, provided on an upper end portion of the container body and extended sidewardly, each of the lug members being connected to a top plate member and each of the side wall members, an interior of each of the lug members being in communication with an interior of the container body; and a sealing wall member, provided in an erected posture between extended end portions of the lug members, for sealing the container body, the sealing wall member being connected to the top plate member and each of the lug members. However, the conventional carton container has been disadvantageous in that the lug members are difficult to pinch and cut off with fingers so that the lug members must be cut off with a cutting tool, for example, scissors or a cutter.

SUMMARY OF THE INVENTION

It is, therefore, an object of the present invention to provide a container for containing liquid substances such as drinks, body soap, shampoo and rinse, in particular, a container suitable for a refill container, which requires no cutting tool to open the container.

The object of the present invention is achieved by a container comprising:

- a hexahedron-shaped container body having a pair of side wall members and a top plate member;
- a pair of lug members, each being triangle-shaped in a plan view, provided on an upper end portion of said container body and extended sidewardly, each of said lug members being connected to said top plate member and each of said side wall members, an interior of each of said lug members being in communication with an interior of said container body; and
- a sealing wall member, provided in an erected posture between extended end portions of said lug members, for sealing said container body, said sealing wall member being connected to said top plate member and each of said lug members, characterized in that:
- a protruded portion is formed on at least one end portion of said sealing wall member and protruded upwardly beyond an upper edge portion of said sealing wall member.

When the container of the present invention is opened, the protruded portions formed on at least one end portion of the sealing wall member together with the end portion of the sealing wall member are pinched with fingers, and the protruded portions of the sealing wall member and the lug members are cut off from the inner end portion of the protruded portion, so that opening portions are formed in the lug members. The content charged within the container is poured from the opening portion. Incidentally, both of the extended end portions of the lug members are cut off, one of the opening portions serves as an air ventilation hole to facilitate a smooth pouring of the content.

The container according to the present invention requires no cutting tool to open the container. Also, since the container has an advantage that the total areas of the extended end portion and the protruded portion are made wider than conventional ones, forces can be easily applied to the lug members and the lug members can be pinched and cut off with fingers.

DETAILED DESCRIPTION OF THE PREFERRED EMBODIMENT

Figure 1:
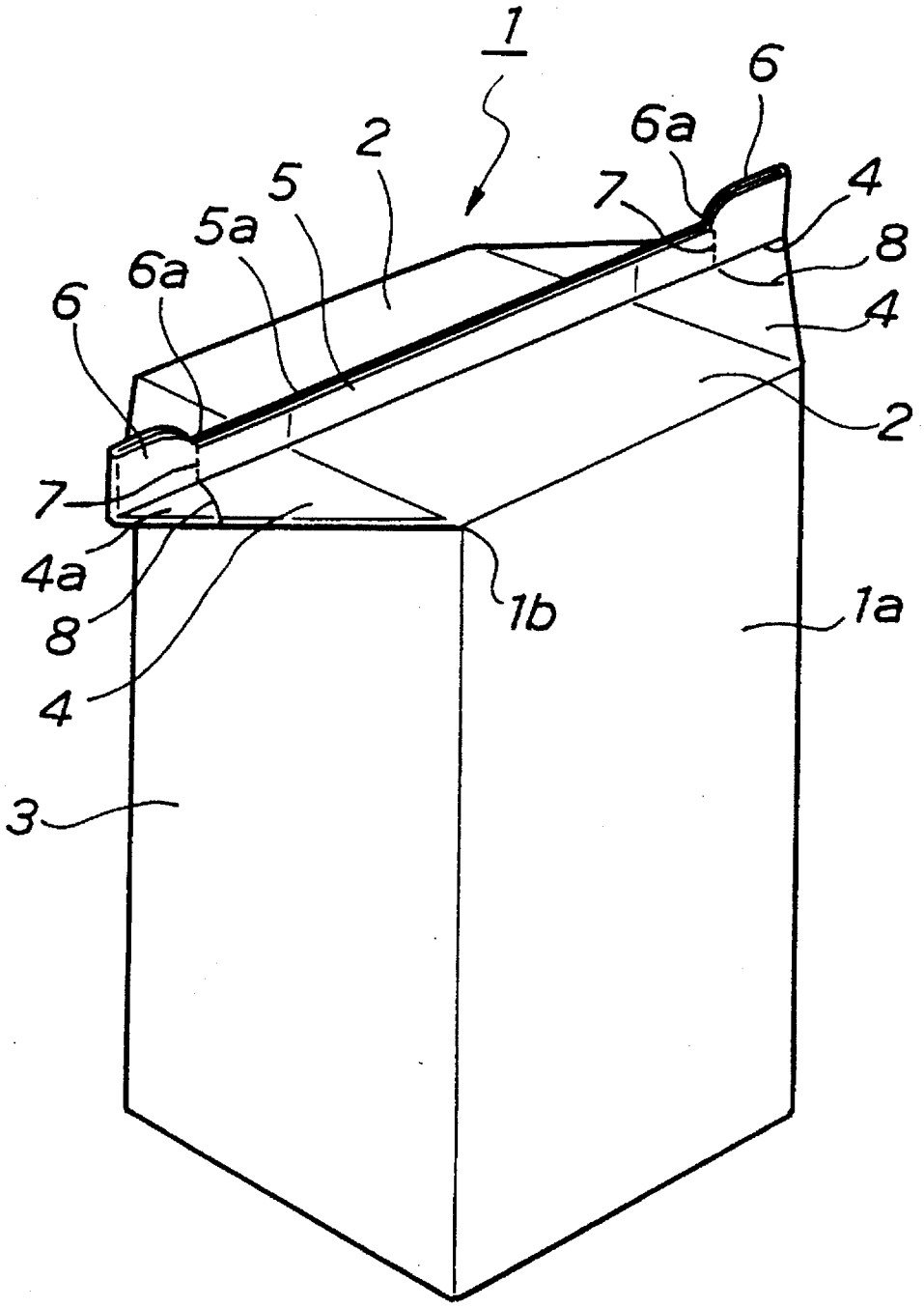
FIG. 1 is a perspective view showing an outer appearance of a first embodiment of the container according to the present invention.

An embodiment of the present invention will be described below in detail with reference to the accompanying drawings.

FIGS. 1 to 4 show a first embodiment of the container according to the present invention. In the illustration, reference numeral 1 denotes a container.

As is shown in FIG. 1, the container 1 mainly comprises a hexahedron-shaped container body 1*a* which is substantially regular-square-shaped taken along a horizontal plane. A pair of lug members 4, 4, each being triangle-shaped in a plan view, are provided on an upper end portion of the container body 1*a*. Each of the lug members 4, 4 is connected to a top plate member 2 and opposite side wall members 3 and extended sidewardly from both sides of the container body 1*a*. An interior of the lug members 4, 4 are in communication with an interior of the container body 1*a*. An upper sealing wall member (sealing wall member) 5 is provided in an erected posture between extended end portions 4*a*, 4*a* of the lug members 4, 4 and adapted to seal the container body 1. The upper sealing wall member 5 is connected to the top plate member 2 and each of the lug members 4, 4.

The upper sealing wall member 5 has a flat upper edge portion 5*a* of a predetermined height. Protruded portions 6, 6 are each formed on opposite end portions of the upper sealing wall member 5 and protruded upwardly beyond the upper edge portion 5*a* of the upper sealing wall member 5. A line of cutting perforations (cutting guide line) 7 is formed in the upper sealing wall member 5 in such a manner as to extend downwardly from an inner end portion 6*a* of each protruded portion 6.

On the other hand, a cutting guide half line 8 which is continuously connected with the line of cutting perforations 7 is formed on the extended end portion 4*a* of each lug member 4, so that an opening portion 9 (see FIG. 4) is formed by cutting the extended end portion 4*a* of each lug member 4 along the cutting guide half line 8.

A bottom plate member of the container body 1*a* (not shown) is defined as a flat bottom as in the case with the conventional so-called flat top type carton container.

Figure 3:
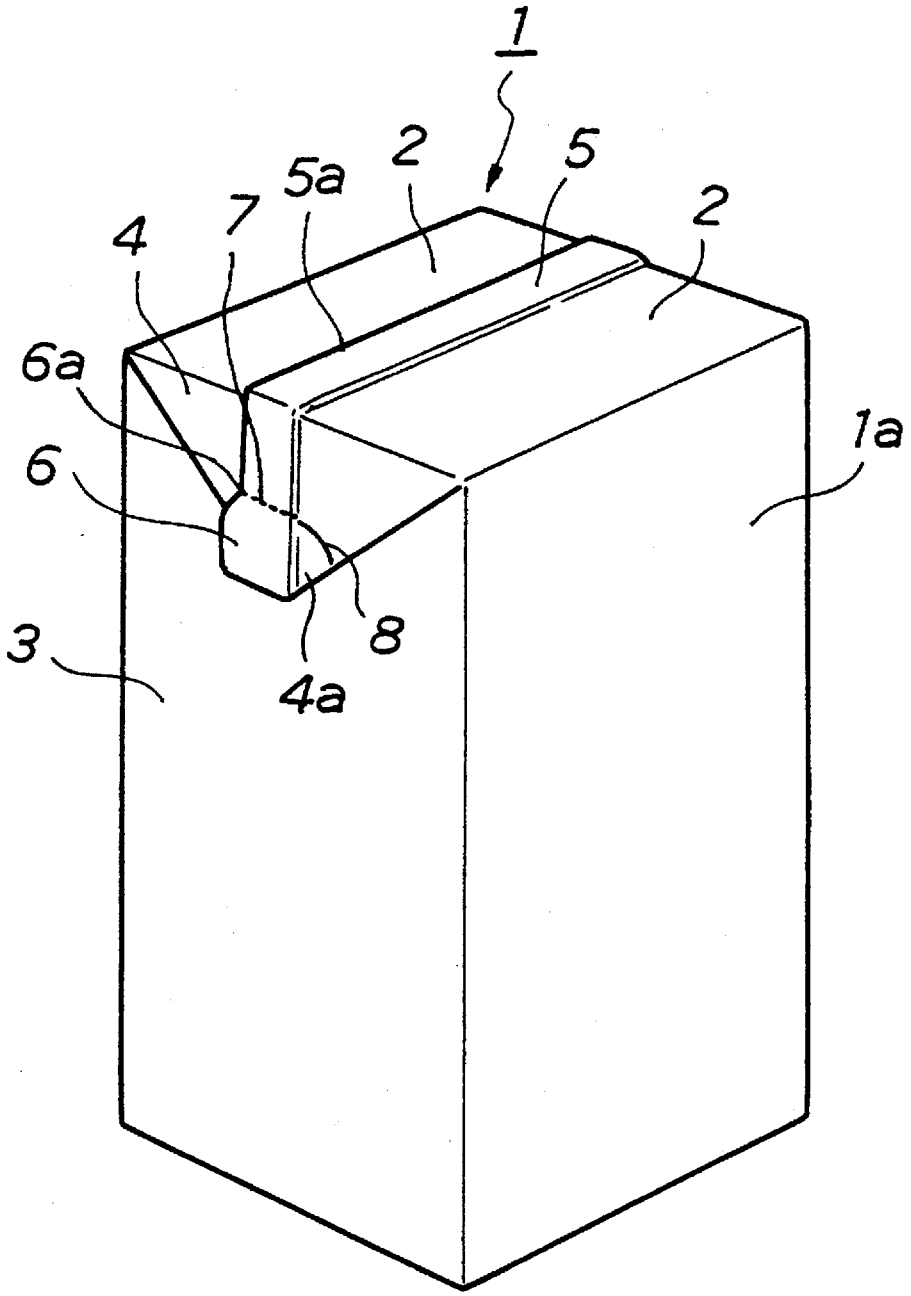
FIG. 3 is a perspective view showing a state of the container of the embodiment during transportation.

As is shown in FIG. 3, the lug members 4 are folded downwardly and adhered to the respective side wall members 3 for easy transportation. When the container of the present invention is transported, the container is placed in a carrying case or the like in the foregoing state.

Figure 2:
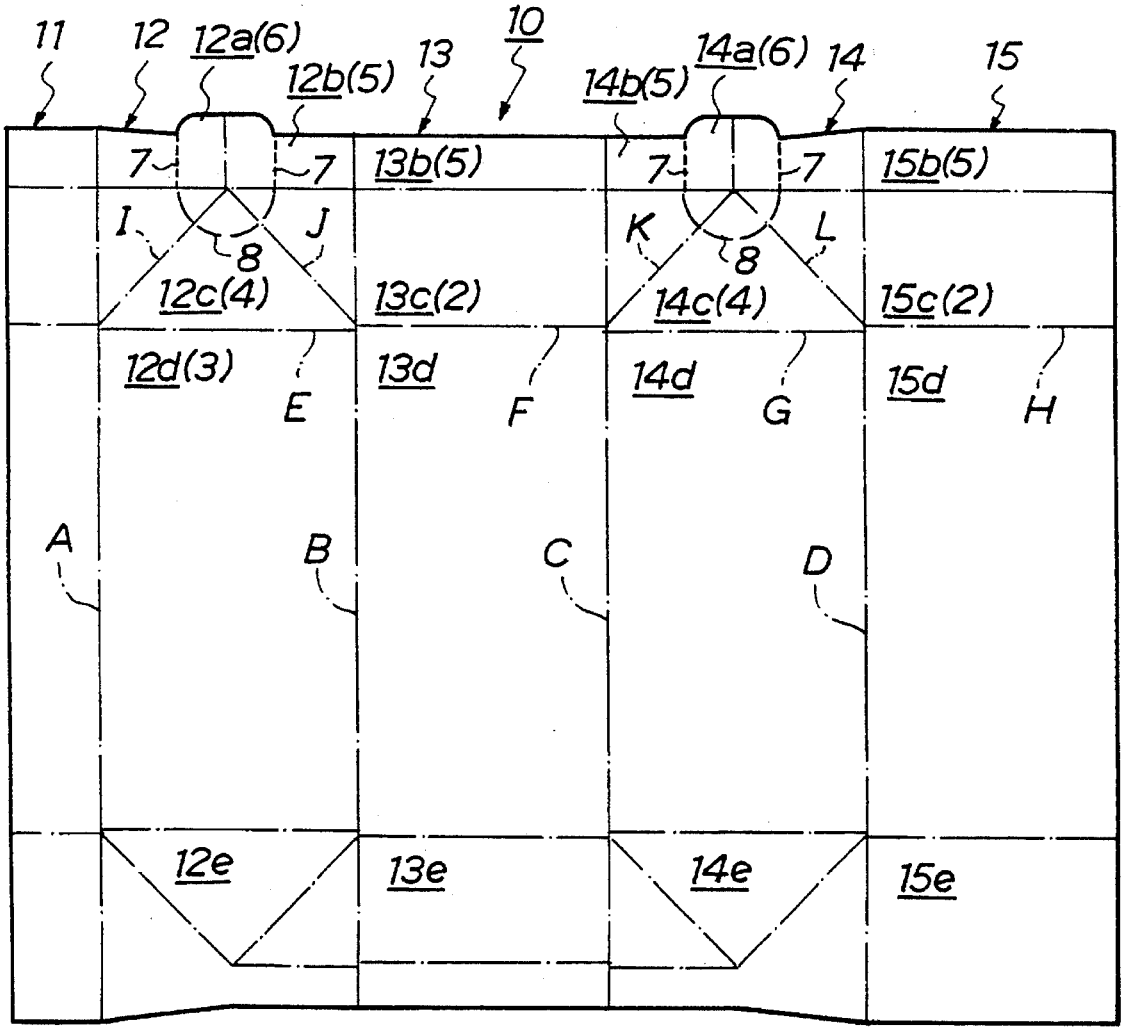
FIG. 2 is a plan view showing the container of the embodiment laid flat.

FIG. 2 shows a plan view of the container 1 according to this embodiment when the container 1 is laid flat. In the illustration, reference numeral 10 denotes a plate-like member.

As is shown in FIG. 2, the plate-like member 10 is a single plate member having a vertical adhesive width 11, a left-hand side plate member 12, a front plate member 13, a right-hand side plate member 14 and a back plate member 15 arranged in series in this order from the left, with fold lines A, B, C and D serving as fold lines.

The left-hand side plate member 12 and the right-hand side plate member 14 are provided respectively with handle widths 12*a*, 14*a*, adhesive widths 12*b*, 14*b*, lug member widths 12*c*, 14*c*, side wall widths 12*d*, 14*d* and bottom member widths 12*e*, 14*e* connected in this order from the top end portion. The handle widths 12*a* and 14*a* are bilaterally symmetric with respect to the vertical center lines of the left-hand side plate member 12 and the right-hand side plate member 14, respectively. The lines of cutting perforations 7,7 extend in parallel to each other and downwardly from the end portions of the handle widths 12*a* and 14*a* via the adhesive widths 12*b* and 14*b*, respectively. In the lug member width portions 12*c* and 14*c*, the cutting guide half cutting lines 8 are formed in such a manner as to connect the lines of perforations forming an arcuate line.

The front plate member 13 and the back plate member 15 are respectively provided with adhesive widths 13*b*, 15*b*, top plate widths 13*c*, 15*c*, side wall widths 13*d*, 15*d*, and bottom plate widths 13*e*, 15*e* connected in this order from the upper end portion.

Next, the steps of fabricating the container 1 from the plate-like member 10 will be described below.

First, the vertical adhesive width 11 and the back plate member 15 are adhered to each other with the fold line A and the back plate member 15 held in alignment, and the left-hand side plate member 12, front plate member 13, right-hand side member 14 and back plate member 15 are folded respectively along the fold lines A, B, C and D, thereby forming a square sleeve-like member.

Then, the adhesive widths 13*b* and 15*b* are adhered, and the handle widths 12*a*, 14*a* and the adhesive widths 12*b*, 14*b* are adhered in semi-folded states, thereby forming the sealing wall member 5 and the protruded portions 6, respectively.

Subsequently, the lug member widths 12*c*, 14*c* and the top plate member widths 13*c*, 15*c* are folded respectively along the fold lines E, F, G and H, and further folded respectively along the fold lines I, J, K and L so that the lug member widths 12 and 13 will be triangle-shaped in a plan view. Thus, the top plate member 2 and the lug member 4 are formed in the container 1.

Incidentally, the bottom plate member of the container 1 is fabricated form a bottom member portions 12*e*, 13*e*, 14*e* and 15*e* in accordance with the same steps as that of fabricating the bottom plate member in the conventional so-called flat top type paper carton container.

For a material of the plate-like member for forming the container according to the present invention, known material, which have been used for the conventional so-called flat top type paper carton container, can be used. Means for adhering the plate-like member is not limited and depends on the material of the plate-like member to be used.

The steps of opening the container 1 will now be described with reference to FIGS. 1, 3 and 4.

The lug member 4 adhered to the side wall member 3 as shown in FIG. 3 is pulled up so as to be erected as shown in FIG. 1. Then, an angular portion 1*b* of the container body 1*a* is pinched with fingers and urged inwardly so that the lug member 4 is bulged to form a square pyramid.

Figure 4:
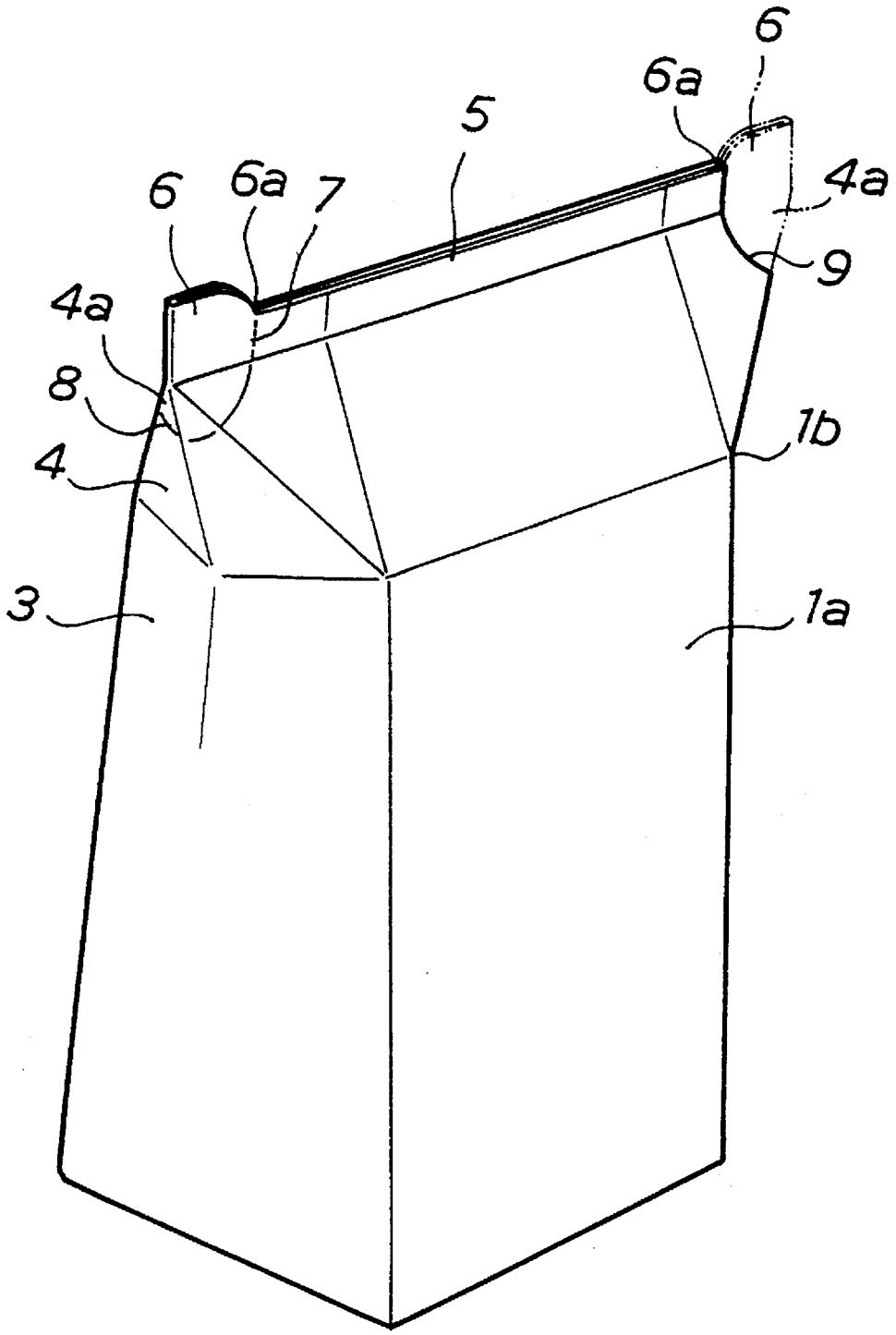
FIG. 4 is a perspective view of the container of the embodiment when opened.
Figure 5A:
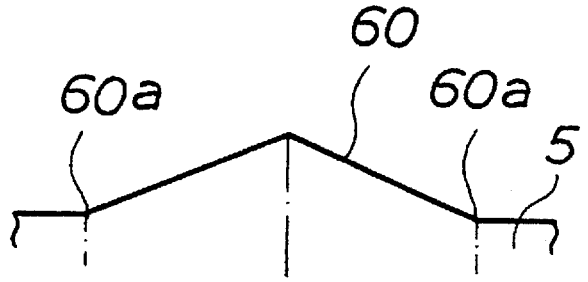
FIG. 5(*a*)–5(*d*) illustrate plan views showing a laid-flat state of important portions of the protruded portions in the container according to the present invention, wherein FIG. 5(*a*) is a plan view showing a laid-flat state of another embodiment of the protruded portion, FIG. 5(*b*) is a plan view showing still another embodiment of the protruded portion, FIG. 5(*c*) is a plan view showing still another embodiment of the protruded portion, and FIG. 5(*d*) is a plan view showing still another embodiment.
Figure 5B:
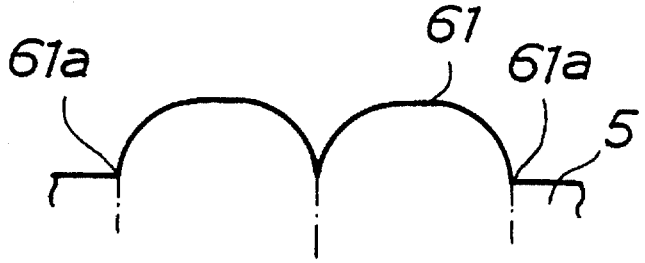
Figure 5C:
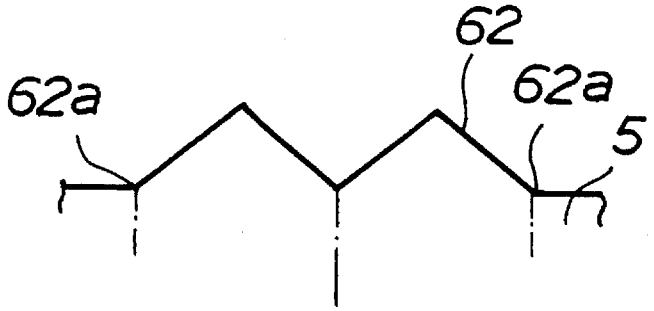
Figure 5D:
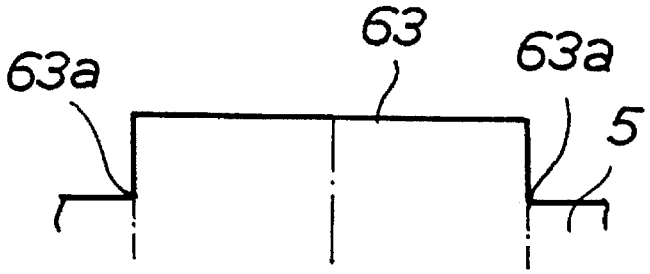

Next, as shown in FIG. 4, a substantially central portion of the upper sealing wall member 5 is held with one hand, the protruded portion 6 and one end of the upper sealing wall member 5 are pinched with fingers of the other hand, and the protruded portions 6 are folded to tear up the upper sealing wall member 5 vertically along the line of cutting perforations 7. Then, the extended end portion 4*a* of the lug member 4 is cut off along the cutting guide half cutting line 8 to form the opening portion 9. Thus, the container 1 is opened. Similarly, the extended end portion 4*a* of the other lug member 4 is cut off to form another opening portion. The content of the container is poured into an inlet portion of a container body of, for example, a container having a pumping means in such a manner that the side wall members 3 are held with a hand, with one opening serving as an outlet port and the other opening serving as an air ventilation hole.

As described above, the container according to this embodiment requires no cutting tool to open the container. Furthermore, since the areas of the extended end portion 4*a* and the protruded portion 6 are larger than those in the conventional container, the lug members 4 are easy to pinch with fingers. Therefore, the lug member 4 can be easily applied with forces and cut off with fingers.

Next, a second embodiment of the present invention will be described. The features which are not described in detail in the second embodiment are the same as those in the first embodiment, and the detailed descriptions made as to such features in the first embodiment can be also applied to the second embodiment.

In the second embodiment, the plate-like member is made of a material comprising a paper layer serving as a base material and plastic layers provided at least on the both surfaces of the paper layer, or alternatively a material produced by further providing a barrier layer on the above material. With the use of these materials, opening of the container can still be facilitated. Examples of the plastic material include a polyethylene such as low-density polyethylene (LDPE).

While the container according to the present invention has been particularly shown and described with reference to the above-mentioned embodiments, it will be understood by those skilled in the art that it is not limited thereto, and size, shape and configuration of parts can be changed appropriately without departing from the spirit and scope of the present invention.

For example, in the above-mentioned container 1, protruded portions 6 are formed on both end portions of the upper sealing wall member 5, so that both of the lug members can be cut off easily. However, the protruded portion may be provided on only one end portion of the upper sealing wall member 5.

Further, in the above-mentioned embodiments, each protruded portion 6 is formed into a substantially trapezoidal shape in a side view. However, the protruded portion is not limited thereto. The protruded portion may be formed, for example, into a shape obtained by folding handle widths 60 to 63 into a half along a one-dot broken line as shown in FIGS. 5(*a*) to 5(*d*).

Furthermore, in the above-mentioned embodiments, the line of cutting perforations 7 is formed as the cutting guide line. Alternatively, a semi-cutting line may be employed for the cutting guide line, and in this case, it exhibits the same functions and advantageous effects as obtained in the above-mentioned embodiments. Although it is preferred that the container of the present invention is formed with the cutting guide line, the container may be configurated such that the cutting guide line is not formed since the total areas of the protruded portion and the extended end portion are made large enough to facilitate pinching of the lug member with fingers. Thus, even if the cutting guide line is not formed, the lug member can be pinched with fingers and the lug member can be easily cut off.

Further, in the container 1 of the above-mentioned embodiments, the container body la is configurated to have a substantially regular square shape, but it is not limited thereto. Alternatively, it may be configurated to have a rectangular shape taken along a horizontal plane.

What is claimed is:

1. A container comprising:

a hexahedron-shaped container body having a pair of side wall members and a top plate member;

a pair of lug members, each of said lug members being triangular shaped in a plan view, each of said lug members being provided on opposite ends of an upper end portion of said container body and having extended end portions which extend sidewardly, each of said lug members being connected to said top plate member and each of said side wall members, an interior of each of said lug members being in communication with an interior of said container body; and a sealing wall member, provided in an erected posture between the extended end portions of said lug members, for sealing said container body, said sealing wall member being connected to said top plate member and each of said lug members;

wherein:

a protruded portion is formed on at least one end portion of said sealing wall member and protruded upwardly beyond an upper edge portion of said sealing wall member;

a cutting guide line is formed in said sealing wall member which extends downwardly from an inner end portion of said protruded portion, said cutting guide line defining a border between the sealing wall member and the protruded portion; and a cutting guide half line is formed on each of said lug members in such a manner that the cutting guide half line is continuously connected to said cutting guide line, for forming an opening portion at said lug member, said cutting guide half line forming a border between said lug members and the corresponding extended end portions.

* * * * *